US008251219B1

(12) United States Patent
Lewis

(10) Patent No.: US 8,251,219 B1
(45) Date of Patent: Aug. 28, 2012

(54) PACKAGE FOR MEDICINE

(75) Inventor: J. Randolph Lewis, Deer Park, IL (US)

(73) Assignee: Walgreen Co., Deerfield, IL (US)

( * ) Notice: Subject to any disclaimer, the term of this patent is extended or adjusted under 35 U.S.C. 154(b) by 10 days.

(21) Appl. No.: 11/876,204

(22) Filed: Oct. 22, 2007

(51) Int. Cl.
*B65D 1/34* (2006.01)

(52) U.S. Cl. ..... 206/562; 206/531; 206/563; 206/528; 220/23.87; 220/23.88

(58) Field of Classification Search ..... 206/531, 206/538, 539, 461, 462, 463, 469, 528, 429, 206/192; 220/23.2, 23.4, 23.83, 23.87, 23.88, 220/23.89
See application file for complete search history.

(56) References Cited

U.S. PATENT DOCUMENTS

| | | | | |
|---|---|---|---|---|
| 2,973,087 | A | 2/1961 | Rohdin | |
| 3,069,273 | A | 12/1962 | Wayne | |
| 3,135,455 | A | 6/1964 | Santangelo | |
| 3,279,596 | A | 10/1966 | Prym et al. | |
| 3,283,885 | A | 11/1966 | Grunewald et al. | |
| 3,305,077 | A * | 2/1967 | Greif et al. | 206/232 |
| 3,324,995 | A * | 6/1967 | Sharp, Jr. | 206/534 |
| 3,351,192 | A * | 11/1967 | La Plante | 206/532 |
| 3,414,414 | A * | 12/1968 | Christine et al. | 426/122 |
| 3,503,493 | A | 3/1970 | Nagy | |
| 3,529,718 | A | 9/1970 | Zaremski | |
| 3,659,706 | A | 5/1972 | Serrell | |
| 3,660,960 | A * | 5/1972 | Inman | 53/412 |
| 3,737,029 | A | 6/1973 | Serrell et al. | |
| 3,743,084 | A | 7/1973 | Douglas | |
| 3,780,856 | A | 12/1973 | Braverman | |

(Continued)

FOREIGN PATENT DOCUMENTS

CA 2 629 458 A1 10/2009

(Continued)

OTHER PUBLICATIONS

Final Office Action for U.S. Appl. No. 12/276,083 dated Apr. 1, 2010.

(Continued)

*Primary Examiner* — J. Gregory Pickett
*Assistant Examiner* — Raven Collins
(74) *Attorney, Agent, or Firm* — Francis C. Kowalik, Walgreen Co.; Marshall, Gerstein & Borun LLP; Randall G. Rueth

(57) ABSTRACT

A new package for medicine has an extended base section that has a generally planar top surface. A series of separate receptacles with frusto-conical walls are positioned across the base section. The receptacles are not integral with (or adhered to) the base section. Instead, each of the receptacles is nested in one of a series of apertures in the base section. Each receptacle has a flange that extends outwardly from and surrounds the opening on the receptacle. The flange has a top surface that is wider than the aperture in which the receptacle is nested, preventing the receptacle from falling through the aperture. A flexible, removable top sheet is sealed to a part of the top surface of the base section, sealing the medicine within the walls of the receptacles and preventing the receptacles from being lifted out of the aperture until the top sheet is peeled back. The top sheet may be adhered to the base section along lines of adhesion that surround each of the openings. Perforations in the top sheet enable individual receptacles to be exposed and removed from the base section without exposing other receptacles.

15 Claims, 7 Drawing Sheets

U.S. PATENT DOCUMENTS 3,809,221 A 5/1974 Compere
3,811,564 A 5/1974 Braber
3,817,393 A 6/1974 Neilsen
3,856,144 A * 12/1974 Kelly ..... 206/462
3,921,804 A * 11/1975 Tester ..... 206/531
3,924,748 A 12/1975 Braverman
4,120,399 A 10/1978 Clarke
4,159,771 A 7/1979 Komatsu et al.
4,192,425 A 3/1980 Landau et al.
4,196,809 A 4/1980 Tonrey
4,211,329 A 7/1980 Braverman
4,295,567 A 10/1981 Knudsen et al.
4,305,502 A * 12/1981 Gregory et al. ..... 206/532
4,340,141 A 7/1982 Fischer
4,364,549 A 12/1982 Komossa et al.
4,384,649 A * 5/1983 Brodsky ..... 206/538
4,428,709 A 1/1984 Peters
4,437,579 A 3/1984 Obland
4,673,086 A 6/1987 Braverman et al.
4,790,440 A 12/1988 Leszczak
4,803,048 A 2/1989 Nason
4,844,246 A 7/1989 Harrison et al.
4,860,899 A 8/1989 McKee
4,889,236 A 12/1989 Bartell et al.
4,889,238 A 12/1989 Batchelor
4,909,414 A 3/1990 Heath
4,946,038 A 8/1990 Eaton
4,955,481 A 9/1990 Novinski et al.
4,975,015 A 12/1990 Harding
4,989,733 A 2/1991 Patry
5,009,894 A 4/1991 Hsiao
5,014,851 A 5/1991 Wick
5,044,498 A * 9/1991 Galiegue et al. ..... 206/429
5,050,739 A * 9/1991 Hannan et al. ..... 206/531
5,163,559 A 11/1992 Bunin
5,209,354 A 5/1993 Thornhill et al.
5,232,907 A * 8/1993 Matsuhiro et al. ..... 505/500
5,259,503 A 11/1993 Steingraber, Jr.
5,265,728 A 11/1993 Allendorf et al.
5,323,907 A 6/1994 Kalvelage
5,377,836 A 1/1995 Eisenbraun
5,390,796 A 2/1995 Kerfoot, Jr.
5,431,283 A 7/1995 Weinstein et al.
5,460,471 A 10/1995 Connor et al.
5,509,773 A 4/1996 Connor et al.
5,515,972 A 5/1996 Shames
5,549,204 A 8/1996 Toren et al.
5,564,593 A 10/1996 East, Sr.
RE35,445 E 2/1997 Pora
5,685,420 A 11/1997 Martin et al.
5,720,384 A 2/1998 Wu-Chen
5,740,717 A 4/1998 Sowden et al.
5,775,505 A 7/1998 Vasquez et al.
5,788,079 A 8/1998 Bouthiette et al.
5,836,615 A 11/1998 Elliot et al.
5,915,559 A 6/1999 Hulick et al.
5,954,202 A 9/1999 Mellon
6,021,623 A 2/2000 Bouthiette et al.
6,023,916 A 2/2000 Bouthiette et al.
6,024,222 A 2/2000 Friberg et al.
6,024,247 A 2/2000 Birr et al.
6,155,423 A 12/2000 Katzner et al.
6,206,233 B1 3/2001 Schulze
6,219,997 B1 4/2001 Friberg et al.
6,244,462 B1 6/2001 Ehrensvard et al.
6,318,051 B1 11/2001 Preiss et al.
6,349,831 B1 2/2002 Buss
6,382,412 B1 5/2002 Wood
6,382,420 B1 5/2002 Bouthiette et al.
6,412,636 B1 7/2002 Jones et al.
6,491,211 B1 12/2002 Evans et al.
6,499,595 B1 12/2002 Petricca
6,520,329 B1 2/2003 Fuchs et al.
6,523,686 B1 2/2003 Bae
6,543,616 B1 4/2003 Peterson
6,550,618 B2 4/2003 Peterson
6,557,740 B1 5/2003 Dent
6,628,199 B1 9/2003 Ehrensvard et al.
6,648,140 B2 11/2003 Petricca
6,652,215 B1 11/2003 Parker et al.
6,679,376 B2 1/2004 Chen
6,681,935 B1 1/2004 Lewis
6,698,425 B1 3/2004 Widerstrom et al.
6,708,826 B1 3/2004 Ginsberg et al.
6,752,272 B2 6/2004 Jones et al.
6,776,288 B2 8/2004 Kopecky
6,802,422 B2 10/2004 Kalvelage et al.
6,848,580 B2 2/2005 Paliotta et al.
6,951,282 B2 10/2005 Jones
6,964,338 B2 11/2005 Kancsar et al.
6,978,894 B2 12/2005 Mundt
6,981,592 B2 * 1/2006 Siegel ..... 206/538
6,997,320 B1 2/2006 Kancsar et al.
6,997,344 B2 2/2006 Brown et al.
7,000,768 B2 2/2006 Morita et al.
7,025,207 B2 4/2006 Breu et al.
7,055,294 B1 6/2006 Lewis
7,063,211 B2 6/2006 Williams-Hartman
7,090,079 B2 8/2006 Ehrlund et al.
7,097,037 B1 8/2006 Keffeler et al.
7,126,879 B2 10/2006 Snyder
7,188,728 B2 3/2007 Williams-Hartman
7,188,729 B2 3/2007 DeJonge
7,308,984 B2 12/2007 Bouthiette et al.
7,336,564 B2 2/2008 Feodoroff et al.
2002/0045184 A1 4/2002 Chen
2002/0104773 A1 8/2002 Kalvelage et al.
2002/0134694 A1 9/2002 Cherng
2002/0197098 A1 12/2002 Palmer
2003/0031595 A1 2/2003 Kirchhevel et al.
2003/0032190 A1 2/2003 Brown et al.
2003/0034271 A1 2/2003 Burridge
2004/0026293 A1 2/2004 Hughes
2004/0069675 A1 4/2004 Stevens
2004/0108240 A1 6/2004 Ragot
2004/0188315 A1 9/2004 Morita et al.
2005/0051454 A1 3/2005 Coe et al.
2005/0082194 A1 4/2005 Fry et al.
2005/0102838 A1 5/2005 Leason
2005/0109658 A1 5/2005 Bindford
2005/0112194 A1 5/2005 Gervais et al.
2005/0173291 A1 8/2005 Specker et al.
2005/0178692 A1 8/2005 Chang
2005/0210682 A1 9/2005 Bartholin
2005/0238415 A1 10/2005 Busam et al.
2005/0256830 A1 11/2005 Siegel et al.
2005/0269238 A1 12/2005 Reape et al.
2005/0274643 A1 12/2005 Arnold
2005/0274644 A1 12/2005 Williams-Hartman
2006/0021900 A1 2/2006 Feodoroff
2006/0042987 A1 3/2006 Buss
2006/0060597 A1 3/2006 Stevens
2006/0144749 A1 7/2006 Arnold et al.
2006/0249420 A1 11/2006 Hession
2006/0289328 A1 12/2006 Hession
2007/0023317 A1 2/2007 Brozell et al.
2007/0045149 A1 3/2007 Hession
2007/0048413 A1 3/2007 Glydon
2007/0056876 A1 3/2007 Jones
2007/0084746 A1 4/2007 Udo et al.
2007/0084747 A1 4/2007 Gherdan et al.
2007/0125679 A1 6/2007 Smith
2007/0205131 A1 9/2007 Bouthiette
2007/0205132 A1 9/2007 Bouthiette
2007/0205133 A1 9/2007 Valentine et al.
2007/0284280 A1 12/2007 Young
2008/0023366 A1 1/2008 Bouthiette
2008/0110791 A1 5/2008 Specker
2008/0265011 A1 10/2008 Specker
2008/0289989 A1 * 11/2008 Kalvelage et al. ..... 206/531
2009/0078051 A1 3/2009 Twerdochlib et al.
2009/0242451 A1 10/2009 Kessler

FOREIGN PATENT DOCUMENTS

DE 4429503 A1 2/1996
EP 1 270 441 A1 1/2003
EP 1 505 017 A1 2/2005

| | | | |
|---|---|---|---|
| EP | 1 505 018 | A1 | 2/2005 |
| EP | 1 884 360 | A2 | 2/2008 |
| EP | 1 930 251 | A1 | 6/2008 |
| EP | 1 964 788 | A1 | 9/2008 |
| EP | 1 985 544 | B1 | 10/2008 |
| EP | 2 090 525 | A1 | 8/2009 |
| EP | 2 112 078 | A1 | 10/2009 |
| FR | 2750403 | A1 | 1/1998 |
| WO | WO-98/56704 | A2 | 12/1998 |
| WO | WO-03/053794 | A1 | 7/2003 |
| WO | WO-03/076303 | A1 | 9/2003 |
| WO | WO-03/089333 | A1 | 10/2003 |
| WO | WO-2004/103857 | A1 | 12/2004 |
| WO | WO-2005/023672 | A1 | 3/2005 |
| WO | WO-2005/110864 | A1 | 11/2005 |
| WO | WO-2005/110889 | A1 | 11/2005 |
| WO | WO-2005/110890 | A1 | 11/2005 |
| WO | WO-2007/046126 | A1 | 4/2007 |
| WO | WO-2009/078051 | A1 | 6/2009 |

OTHER PUBLICATIONS

International Preliminary Report on Patentability for PCT/US09/033054 dated Nov. 30, 2010.

Office action for U.S. Appl. No. 12/275,821 dated Oct. 12, 2010.

DISPILL systeme de distribution de medicaments, "Pour Les Pharmaciens," Retrieved from the Internet on Oct. 8, 2008. <URL:http://www.dispill.com/plateaux.html>.

Medicine-On-Time, "Home Page," Retrieved from the Internet on Oct. 8, 2008. <URL:http://www.medicine-on-time.com>.

MTS Medication Technologies, "Sureseal™," Retrieved from the Internet on Oct. 8, 2008. <URL:http://www.mts-mt.com/index.php?module=NukeWrapper&url=/products/machine.html?idx=13>.

Office action for U.S. Appl. No. 12/130,365 dated Nov. 2, 2009.

Office action for U.S. Appl. No. 12/276,083 dated Nov. 4, 2009.

Office action for U.S. Appl. No. 12/275,805 dated Oct. 30, 2009.

* cited by examiner

PACKAGE FOR MEDICINE

BACKGROUND OF THE INVENTION

The present invention relates generally to packages for medicine, and more particularly to packages in which individual doses of prescription or non-prescription medicine are contained in separate receptacles. (The term "medicine" is used broadly in this document, and is intended to encompass things such as vitamin or nutritional supplements, etc.)

"Blister" packs have been known for many years. Examples can be found, for example, in U.S. Pat. Nos. 2,973,087; 3,811,564; and 4,159,771. U.S. Pat. No. 4,946,038 shows a medicine container in which a single dose of medicine is contained in a tray that has a cover sheet that can be peeled away.

Both U.S. Pat. No. 5,163,5590 and U.S. Pat. No. 7,097,037 show a container that has multiple receptacles in which single doses can be stored. Each receptacle has its own cover that can be peeled away.

BRIEF SUMMARY

The applicants have developed a new package for medicine. Like prior known devices, the package has an extended base section that has a planar top surface. A series of separate receptacles are positioned across the base section. A flexible, removable top sheet is sealed to a part of the top surface of the base section, sealing the medicine within the walls of the receptacles.

Unlike in prior known packages, the receptacles in the new package are not integral with (or adhered to) the base section. Instead, each of the receptacles is nested in one of a series of apertures in the base section. Each receptacle has a flange that extends outwardly from and surrounds the opening on the receptacle. The flange has a planar top surface that is wider than the aperture in which the receptacle is nested, preventing the receptacle from falling through the aperture. Each receptacle is held to the base section by the top sheet, which prevents the receptacle from being lifted out of the aperture until the top sheet is peeled back.

The wall of each receptacle is shaped so that all cross-sections of the receptacle below the opening fit within the aperture in which the receptacle is nested. This configuration permits the receptacle to be easily lifted through the aperture when the top sheet is peeled back. The wall on a receptacle may, for example, be a frusto-conical wall.

The top sheet may be adhered to the base section along lines of adhesion that surround each of the openings. Perforations can be provided in the top sheet, between the lines of adhesion surrounding openings on adjacent receptacles. These perforations enable individual receptacles to be exposed and removed from the base section without exposing other receptacles. Corresponding perforations can also be provided in the base section, between adjacent apertures.

The removable top sheet can be adhered to the top surfaces of the flanges of the receptacles. Adhering the top sheet along the entire circumference of a flange can assure that liquid contents from the receptacle will not spill through the aperture in the base section.

BRIEF DESCRIPTION OF THE DRAWINGS

The invention may be better understood by referring to the accompanying drawings, in which.

DETAILED DESCRIPTION

The package 10 seen in FIGS. 1-4 has three primary components: an extended base section 12, a series of separate receptacles 14, and a removable top sheet 16. Medicine 18, such as pills or tablets, is stored in the receptacles. The medicine can be removed by peeling back the top sheet (FIG. 2), lifting the receptacle from the base section (FIGS. 3 and 4), and then removing the medicine from the receptacle. For example, the receptacle could be used as a cup. Each of these primary components of the package will be discussed in more detail below.

The Base Section

Figure 1:
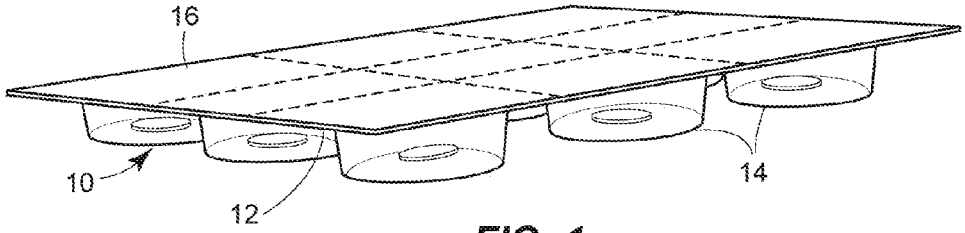
FIGS. 1-4 are perspective views of one embodiment of a package that uses the invention, showing the package in various stages of use.
Figure 2:
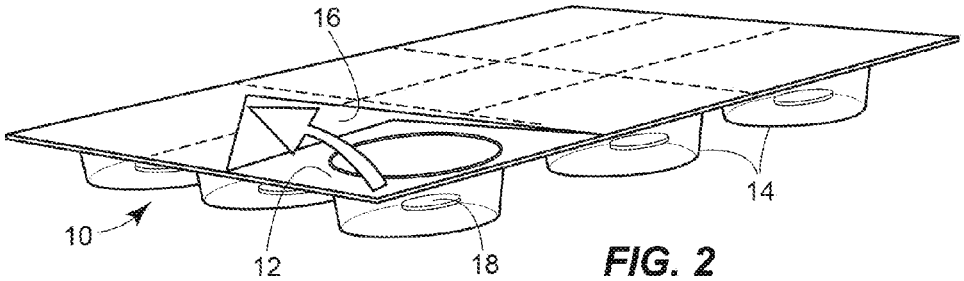
Figure 3:
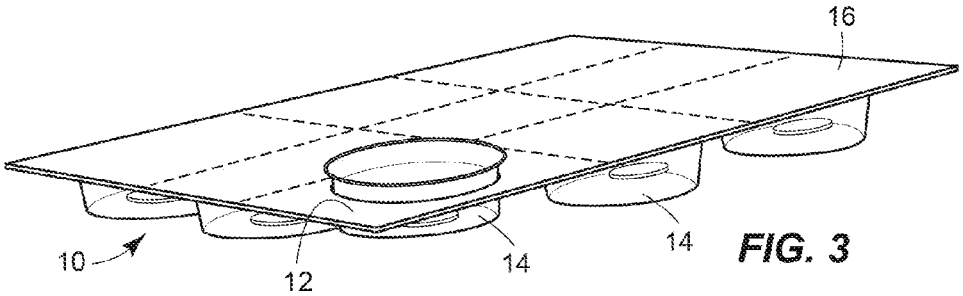
Figure 4:
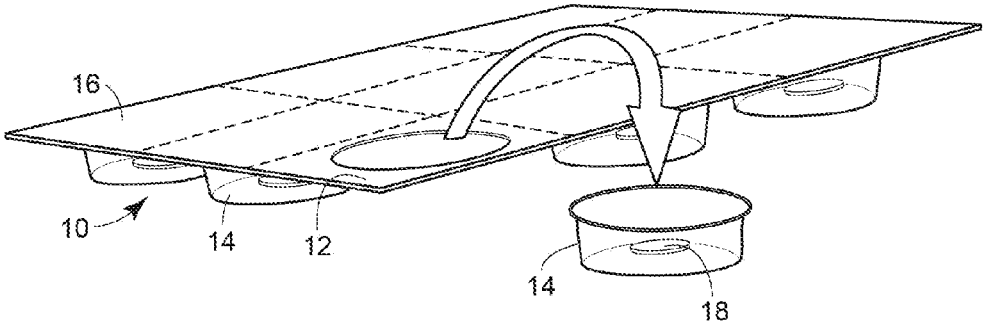
Figure 5:
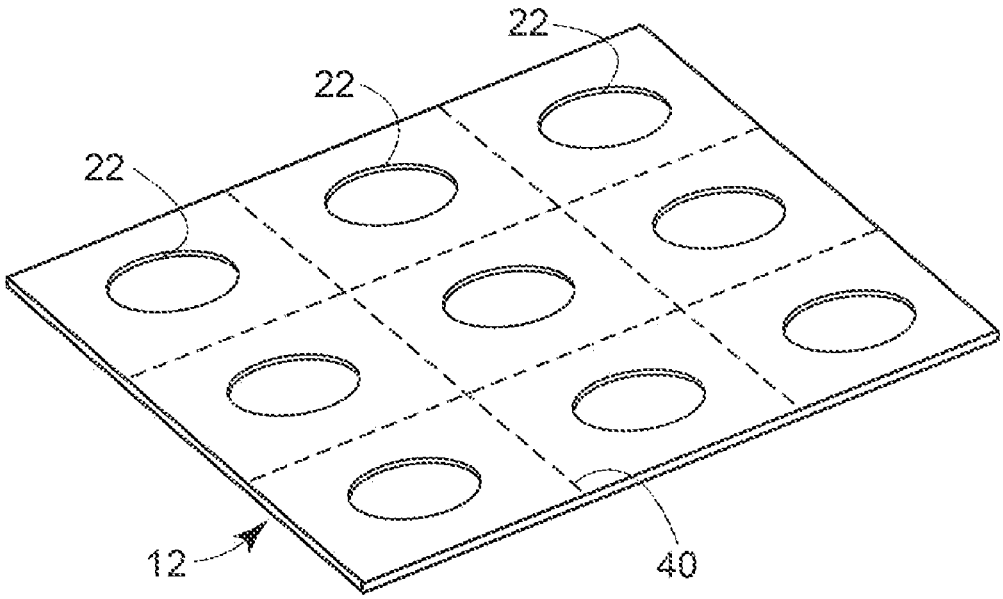
FIG. 5 is a perspective view of the base section of the package of FIG. 1.

The base section 12, best seen in FIG. 5, serves as a base for the package. It is a generally planar element that has a series of apertures 22 that are used to hold the receptacles. In the illustrated example, the base section is made of thin cardboard. Preferably, the base section has a planar top surface, but some unevenness of the top surface is possible. For example, recesses could be provided around the apertures to accommodate flanges on the receptacles.

In some cases, it may be desirable to provide fold lines in the base section 12. Fold lines enable the base section to be folded for more convenient storage. In the example seen in FIGS. 6 and 7, a package 10 can be folded at two pairs of fold lines 24, 26 so that receptacles 14*a* on one part 28 of the base section fit between receptacles 14*b* on another part 30 of the base section. This kind of arrangement (where the distance between one fold line and its nearest row of apertures differs from the distance between the adjacent fold line and its nearest row of apertures) can provide a particularly compact, folded package useful for storage or travel.

The apertures 22 can be arranged in a variety of two-dimensional patterns across the base section 12. The size and shape of the apertures corresponds with the size and shape of the receptacles, which will be discussed below. In the example in FIGS. 1-5, the apertures are circular in cross section, and are arranged in a two-dimensional grid pattern in the base section. Other arrangements are possible. For example, the apertures could be triangular, rectangular (with or without rounded corners), oblong, or even irregular in cross section. Instead of a regular grid, the pattern could have staggered rows, or even a radial or spiral arrangement.

Figure 6:
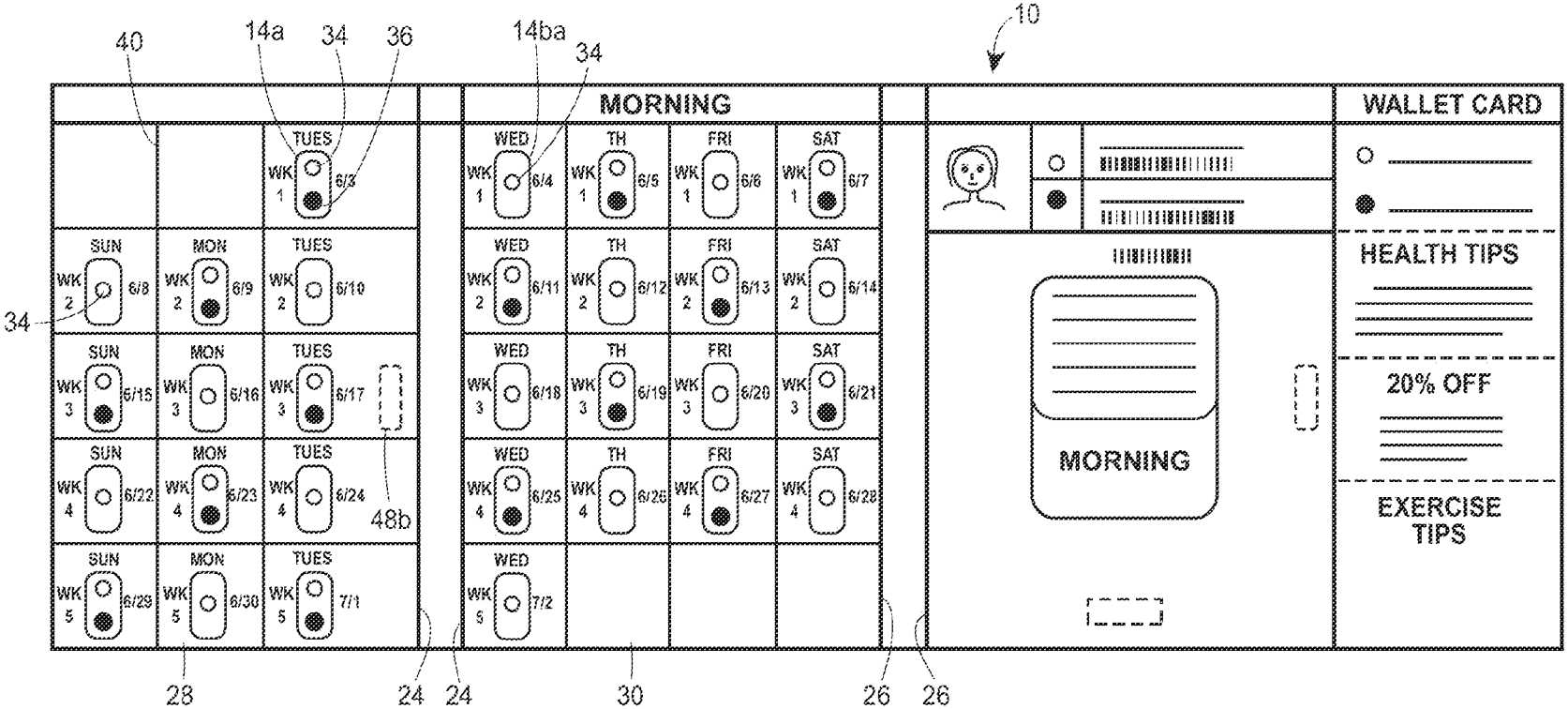
FIG. 6 is a front view of another embodiment of a package that uses the invention.
Figure 7:
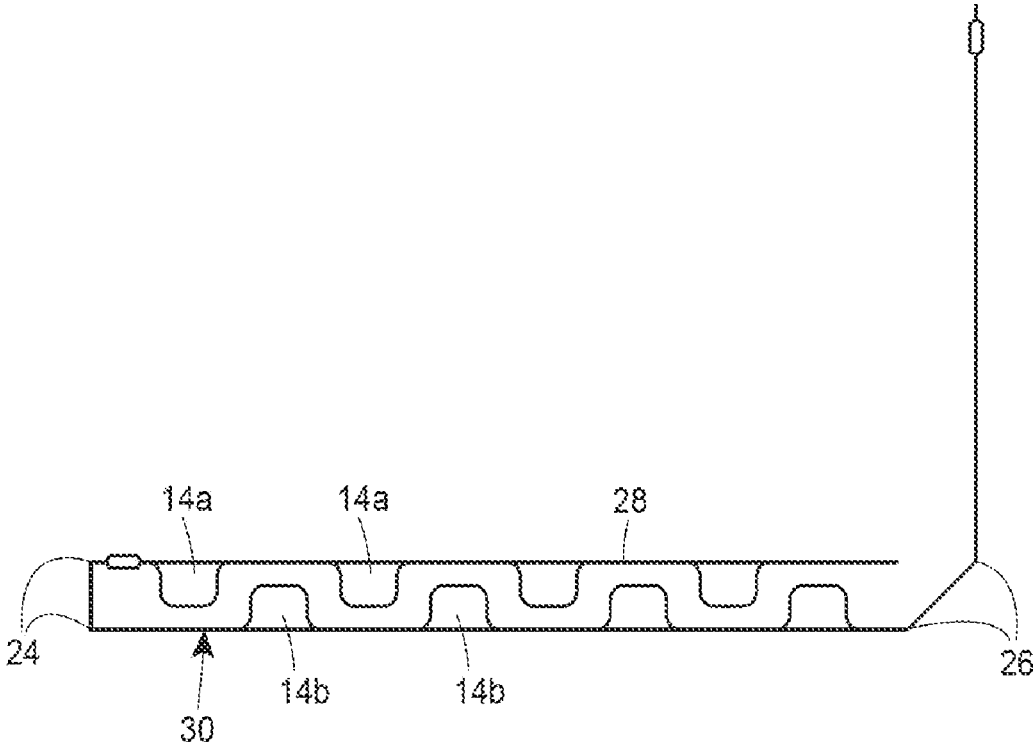
FIG. 7 is a side view of the package of FIG. 6.
Figure 8:
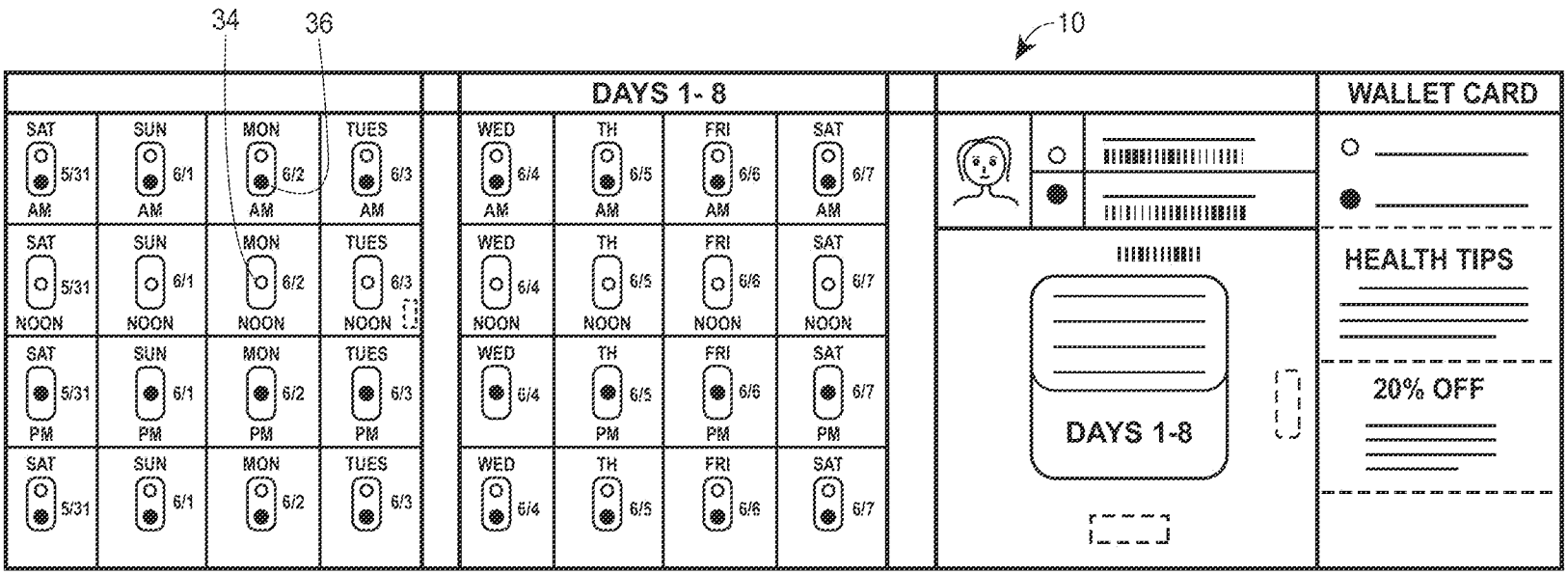
FIG. 8 is a front view of another embodiment of a package that uses the invention.

It will often be preferred for all the apertures 22 on the base section 12 to be the same size and shape, but this may not always be necessary or preferred. The packages seen in FIGS. 6-8 are arranged so that some receptacles hold a single pill or tablet (such as a kind of pill 34 that is to be taken at relatively short intervals), while other receptacles hold a group of pills or tablets (the group including the same kind of pill held in the other receptacle plus another kind of pill 36 that is taken less frequently). When the size or number of pills to be stored in the receptacles will vary, it might, in some circumstances, be desirable to provide receptacles of different sizes or shapes. If receptacles of different sizes or shapes are to be used, then it might be preferred for the sizes or shapes of the apertures to vary, too.

The base section 12 may have perforations 40 between adjacent apertures 22. Perforations make it easier to separate the base section into separate segments, which might be convenient when the user is traveling. In the embodiment of the invention seen in FIGS. 1-4, the perforations are evenly spaced across the length and width of the base section, and pass between each aperture and every adjacent aperture. Alternatively, perforations could be used to divide the base section only into parallel strips. For example, where an individual should be taking medicine several times each day, the base section could be divided by perforations so that each strip includes a full day's worth of doses. This kind of arrangement is illustrated in FIG. 8.

The Receptacles

As stated above, the receptacles 14 are used to hold medicine. Accordingly, they are sized and shaped appropriately. If it is contemplated that the package 10 will be used with a particular kind of medicine (for example, an individual pill having a given shape, or a specific group of pills), then it might be desirable for the receptacles to be configured to facilitate the storage of that particular kind of medicine in each receptacle (and the removal of that kind of medicine from the receptacle). If the package is intended to be used with a variety of different possible kinds of medicine (for example, one set of pills for one customer, and a different set of pills for a different customer), then it might be desirable for the receptacles to be configured to facilitate the storage of a wide range of different possible kinds of medicine.

Figure 9:
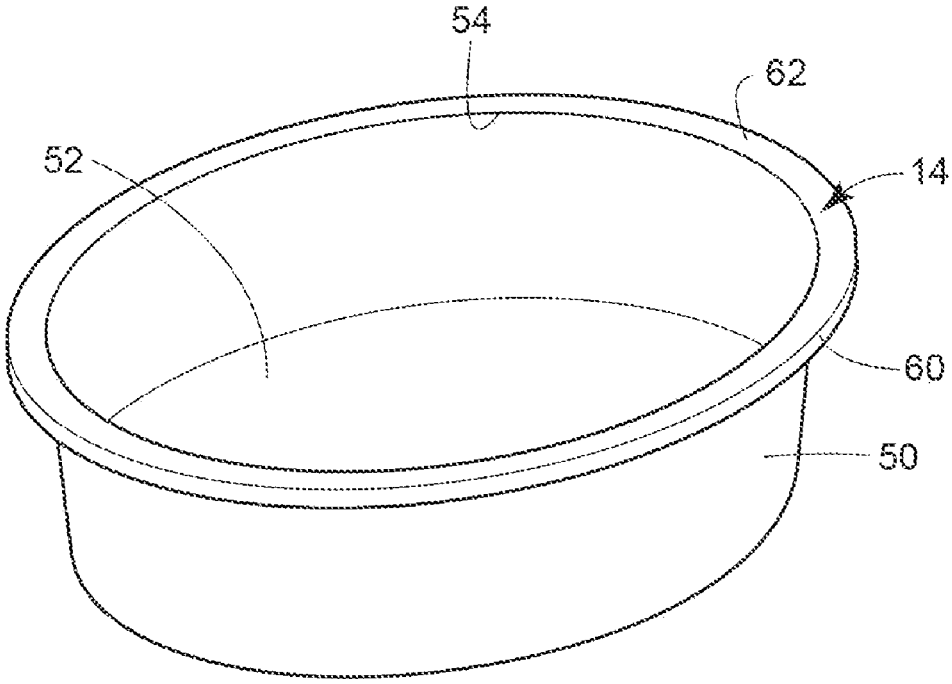
FIG. 9 is an enlarged perspective view of the receptacle used in the package of FIGS. 1-4.
Figure 10:
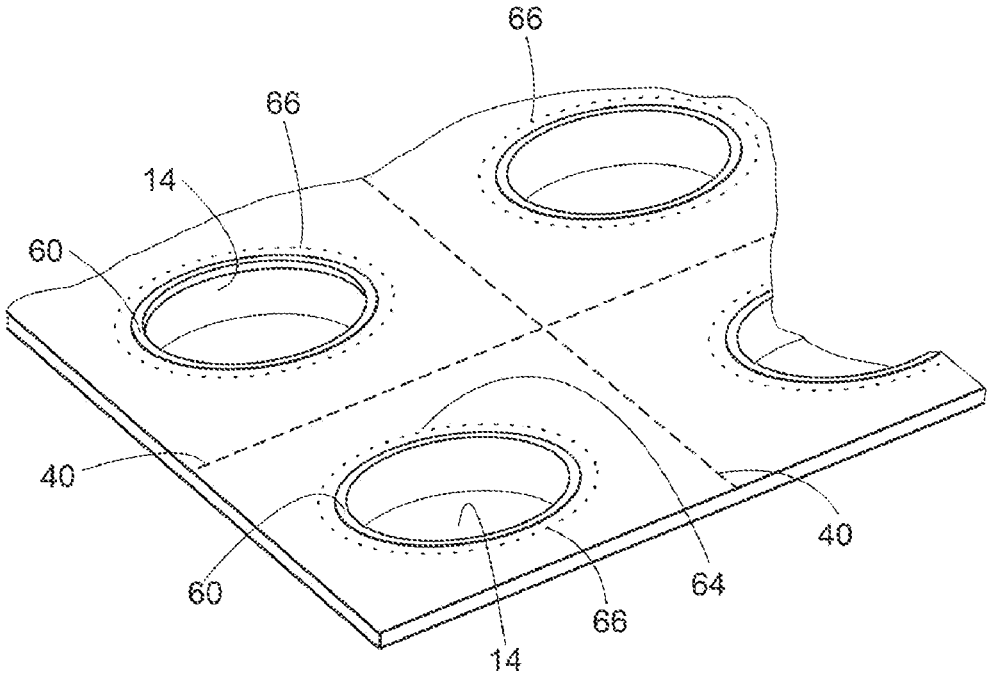
FIG. 10 is an enlarged perspective view of a portion of the base section and receptacles of the package of FIGS. 1-4, with the top sheet removed.

As better seen in FIG. 9, the illustrated receptacles 14 have a wall 50 and a bottom 52 that define a space in which the medicine can be stored. Access is provided through an opening 54 at the top. In the illustrated example, the receptacle is made of plastic, and the wall is a frusto-conical wall that extends downwardly and inwardly from the opening on the receptacle. Other materials and shapes are possible. For example, a hemispherical wall (with no separate bottom) might also be used. It is preferred that all cross sections of the receptacle below the opening fit within the aperture 22 in which the receptacle is nested. In the examples illustrated in FIGS. 1-4, all cross sections of the receptacle below the top opening 54 are circles, and each of those circles has a diameter that is less than the diameter of the aperture in which the receptacle is nested. This allows the receptacle to be easily lifted through the aperture.

The receptacles 14 are nested in the apertures 22, but not adhered to the base section 12. In other words, there is no fastening mechanism that prevents a user from easily lifting the receptacles away from the base section once the top sheet 16 is removed. As a result, even after removal from the base section, the receptacles may be used as a convenient holder for the medicine until it is used. While it might generally be preferred that there be no resistance whatsoever to the receptacles being separated from the base section after the top sheet is removed, in some cases the receptacles might be lightly tacked to base section. A lightly tacked receptacle is not "adhered," as that term is used here, because light tacking does not prevent the user from easily removing the receptacle once the top sheet is removed.

When it is in place, the flexible top sheet 16 prevents the receptacles 14 from being lifted upwardly from the base section 12. Other structure might be desired to prevent the receptacles (or their contents) from slipping downwardly through the apertures 22. The receptacle 14 illustrated in FIG. 9 has an annular flange 60 that serves this function. The flange should be wide enough so that the overall width of the receptacle 14 at its opening 54 is wider than the aperture in which the receptacle is nested. The illustrated flange extends outwardly from and completely surrounds the opening on the receptacle and has an outside diameter that is wider than and exceeds the diameter of the aperture in which the receptacle is nested. Other arrangements are possible. For example, in some circumstances it may not be necessary for the flange to extend all the way around the opening. To prevent the receptacle from falling through the aperture, it may sometimes be enough for flange sections to extend from only one side of the opening, or from only a few points on the opening.

The width of the flange 60 (or flange sections) may vary. In the example seen in FIGS. 1-4 and 10, the flanges do not extend more than half way between adjacent apertures 22. This arrangement prevents the flanges from overlapping each other, and leaves an exposed portion 64 on the upper surface of the base section 12. This will be discussed in more detail below.

The Top Sheet

The illustrated removable top sheet 16 is flexible and made from metal or plastic foil. It is adhered to the top surface of the flanges 60 of each of the receptacles 14 and to the exposed portion 64 of the top surface of the base section 12. The illustrated top sheet is adhered to the base section along of lines of adhesion 66. Adhering the top sheet to the base section is important to hold the receptacles to the base section. While in some circumstances it might be sufficient to seal the top sheet to only the periphery of the base section, providing interior sealing locations (such as along the illustrated lines of adhesion) keeps the top sheet close to the base section, helping to assure that the receptacles do not unintentionally dislodge from the apertures before the top sheet is removed. In this example, the lines of adhesion are close to and completely surround each receptacle 14, but in some circumstances close lines of adhesion might go only part way around the aperture.

In the example seen in FIGS. 1-4, the top sheet 16 covers all of the base section 12. In other examples, such as those seen in FIGS. 6 and 8, the top sheet may cover only part of the base section. Other parts of the base section could be covered, for example, with printed material such as patient information.

The illustrated top sheet 16 is not only adhered to the base section 12 but is also secured to the top surface 62 of the flanges 60 of the receptacles 14. This helps to ensure that the medicine contained in the receptacles does not inadvertently spill from the receptacles before the top sheet is removed. Such spillage might be a concern if the medicine is a small pill or a liquid. Even more protection against spillage might be obtained by using a separate removable cover over some or all of the receptacles, under the top sheet.

In these examples, the top sheet 16 is sealed to the top surface 62 of the flange 60 all the way around the opening 54 of the receptacle 14. While this arrangement may often be preferred (particularly, for example, if no separate cover is provided and the package 10 is used to store liquid medicine), in some circumstances it may be preferred to seal the top sheet to only portions of the flange.

This description of various embodiments of the invention has been provided for illustrative purposes. Revisions or modifications may be apparent to those of ordinary skill in the art, and do not necessarily depart from the invention. The full scope of the invention is set forth in the following claims.

The invention claimed is:

1. A package for medicine that has:

an extended base section;

a generally planar top surface on the base section;

a plurality of apertures in the base section;

a removable top sheet that is sealed to a planar part of the top surface of the base section;

a series of separate receptacles that are nested in the apertures and held to the base section by the top sheet without any structure that prevents a user from easily removing the receptacles from the base section once the top sheet is removed;

an opening on top on each of the receptacles;

a wall on each of the receptacles that extends downwardly from the opening on the receptacle, has an uncovered portion that extends beneath the lowermost edge of the base section, and is shaped so that all cross sections of the receptacle below the opening fit within the aperture in which the receptacle is nested; and a flange section on each of the receptacles that extends outwardly from the opening so that the overall width of the receptacle at its opening is wider than the aperture in which the receptacle is nested.

2. A package as recited in claim 1, in which the removable top sheet is flexible.

3. A package as recited in claim 1, in which the top sheet has perforations between adjacent apertures.

4. A package as recited in claim 1, in which the top sheet is adhered directly to the base section along separate sets of lines of adhesion that surround each aperture.

5. A package as recited in claim 1, in which:

the top sheet is adhered directly to the base section along separate sets of lines of adhesion that surround each aperture; and the top sheet has perforations between the lines of adhesion between adjacent apertures.

6. A package as recited in claim 1, in which both the base section and the top sheet have perforations between adjacent apertures.

7. A package as recited in claim 1, in which the removable top sheet is adhered to the top surface of the flange sections of at least one of the receptacles.

8. A package as recited in claim 1, in which the removable top sheet is adhered to the flange sections of each of the receptacles.

9. A package of medicine a recited in claim 1, in which the wall on the receptacles is a frusto-conical shaped wall.

10. A package of medicine that has:

an extended base section;

a generally planar top surface on the base section;

a plurality of apertures in the base section;

a series of separate receptacles that are nested in the apertures but not adhered or sealed to the base section;

an opening on top of each of the receptacles;

a wall on each of the receptacles that extends downwardly from the opening on the receptacle, has an uncovered side portion that extends beneath the lowermost edge of the base section, and is shaped so that all cross-sections of the receptacle below the opening fit within the aperture in which the receptacle is nested;

a flange section on each of the receptacles that extends outwardly from the opening on the receptacle so that the overall width of the receptacle at its opening is wider than the aperture in which the receptacle is nested;

exposed portions on the base section that extend between the apertures and are uncovered by the flange sections of the receptacles;

a removable top sheet that is sealed to the exposed sections on the base section between the receptacles and to a planar part of the top surface of the base section, holding the receptacles to the base section, and medicine sealed within the walls of the receptacles.

11. A package as recited in claim 10, in which the base section is folded on at least one fold line.

12. A package of light-weight medical pills or tablets that has:

an extended base section;

a generally planar top surface on the base section;

a plurality of circular apertures arranged in a two-dimensional pattern in the base section;

perforations in the base section between adjacent apertures;

a removable top sheet that is flexible and is sealed to the top surface of the flanges of the receptacles and to exposed portions on the base that extend between the apertures and are uncovered by the flange sections of the receptacles a part of the top surface of the base section;

a series of separate receptacles that are nested in the apertures and held to the base section by the top sheet without any other structure that prevents a user from easily removing the receptacles from the base section once the top sheet is removed;

a circular opening on top of each of the receptacles;

a frusto-conical wall on each of the receptacles that extends downwardly and inwardly from the opening on the receptacle and has an uncovered side portion that extends beneath the lowermost edge of the base section; and an annular flange on each of the receptacles that surrounds the opening on the receptacle and has an outside diameter that exceeds the diameter of the aperture in which the receptacle is nested.

13. A package for medicine as recited in claim 10, in which:

the base section is planar.

14. A package for medicine as recited in claim 1, in which:

the separate receptacles are held to the base section by the top sheet without any seal or adhesion of the receptacles to the base section once the top sheet is removed.

15. A package of medicine as recited in claim 12, in which:

the separate receptacles are held to the base section by the top sheet without any seal or adhesion of the receptacles to the base section once the top sheet is removed.

* * * * *